US006441291B2

(12) United States Patent
Hasegawa et al.

(10) Patent No.: US 6,441,291 B2
(45) Date of Patent: Aug. 27, 2002

(54) APPARATUS AND METHOD FOR CREATING CONTENT COMPRISING A COMBINATION OF TEXT DATA AND MUSIC DATA

(75) Inventors: Yutaka Hasegawa; Kosei Terada; Shinji Koezuka, all of Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/842,525

(22) Filed: Apr. 25, 2001

(30) Foreign Application Priority Data

Apr. 28, 2000 (JP) ..... 2000-130239

(51) Int. Cl.[7] ..... A63H 5/00; G04B 13/00; G10H 7/00

(52) U.S. Cl. ..... 84/609; 84/600; 84/610; 84/649; 84/650

(58) Field of Search ..... 84/600–604, 609–610, 84/615, 618, 622, 634, 649–650, 653, 656, 666; 434/307 A

(56) References Cited

U.S. PATENT DOCUMENTS 4,731,847 A * 3/1988 Lybrook et al. ..... 84/622
5,524,193 A 6/1996 Covington et al.
5,616,876 A * 4/1997 Cluts ..... 84/609
5,675,788 A 10/1997 Husick et al.
5,739,451 A * 4/1998 Winksy et al. ..... 84/609
5,969,283 A * 10/1999 Looney et al. ..... 84/609
6,021,412 A 2/2000 Ho et al.
6,175,071 B1 * 1/2001 Ito ..... 84/609
6,232,539 B1 * 5/2001 Looney et al. ..... 84/609
6,243,725 B1 * 6/2001 Hempleman et al. ..... 84/601

FOREIGN PATENT DOCUMENTS

EP 0 627 690 A2 12/1994
GB 2 354 094 A 3/2001

OTHER PUBLICATIONS

The Story of Peter and the Wolf, Text and Music Version of Peter and the Wolf, Music Links, htt;://library.thinkquest.org/17321/data/pwstory.html see especially http://library.thinkquest.org/17321/data/esmusic.html.

* cited by examiner

*Primary Examiner*—Marlon T. Fletcher
(74) *Attorney, Agent, or Firm*—Morrison & Foerster LLP

(57) ABSTRACT

Supplied text data set is classified into any one of a plurality of categories in accordance with the substance of the supplied text data set, and a musical composition data set is selected or generated which corresponds to the category of the text data. Content information contains first position information indicative of a stored position, such as an URL, of the supplied text data set, and second position information indicative of a stored position, such as an URL, of the selected or generated musical composition data set. One set of the content may include a plurality of text data sets and a plurality of musical composition data sets, and these text data sets and musical composition data sets may be reproduced in sequence.

35 Claims, 5 Drawing Sheets

APPARATUS AND METHOD FOR CREATING CONTENT COMPRISING A COMBINATION OF TEXT DATA AND MUSIC DATA

BACKGROUND OF THE INVENTION

The present invention relates to a content creation apparatus and method, content distribution system and method, content reproduction apparatus and method for creating, distributing and reproducing, via a communication network, content that comprises a combination of text data, music data, etc., as well as a storage media storing instructions for implementing the methods. In particular, the present invention concerns an improved content creation apparatus and method, content distribution system and method, content reproduction apparatus and method which can create content including background music (BGM) sounds fitting the substance or contents (hereinafter, the term "substance", rather than the term "contents", is used to clearly differentiate from a similar term "content" that is used to mean "content information" to be created and distributed in the present invention) of a text and which allow any interested user to readily obtain the thus-created content and then have the text visually displayed while audibly reproducing the BGM sounds in accordance with the obtained content, as well as a storage media storing instructions for implementing the above-mentioned methods.

A great variety of pieces of information, such as political news, economic news, local news, sports news, weather forecast, gourmet-oriented information and information on fashionable and attractive spots, are today distributed in a variety of forms. In recent years, network-based information distribution facilities have been popularly employed, as a new form of information distribution, which use a wired or wireless communication network, such as the Internet, to distribute news and various other information to users in the form of machine-readable texts, unlike the traditional forms of information distribution such as newspapers, magazines and television and radio broadcasting. Among conventionally-known examples of the network-based information distribution facilities are electric news tapes displayed on electric bulletin boards attached to wall surfaces of trains (e.g., "Shinkansen" or Superexpress trains in Japan), buildings, etc. and news (mail news) electronically mailed to individual interested users or subscribers. Because suppliers or distributors of news and various other information normally supply users with latest news and information one after another, such a new form of information distribution based on communication networks allow the users to readily gain up-to-date news and other information at any desired time.

However, the conventionally-known network-based information distribution facilities, such as the electric news tapes and electronically mailed news (mail news), are arranged to display the distributed news, weather forecast and various other information only in the form of text data (including number data), and are accompanied by no background music (BGM) sounds at all or, if any, by mere BGM sounds having no relation or association with the substance of distributed news, weather forecast and other information. Accordingly, the distributors of the news, weather forecast and other information could not draw deep users interest or attention to the distributed information. Also, when BGM having no relation to the substance of the distributed news, weather forecast or other information is being played, the users or viewers could hardly view the distributed information pleasantly.

SUMMARY OF THE INVENTION

In view of the foregoing, it is an object of the present invention to provide a content creation apparatus and method which can create a music content fitting the substance of text data.

It is another object of the present invention to provide a content distribution system and method which can distribute content comprising a combination of text data and music data fitting the text data, as well as a communication terminal apparatus and method which are suitable for use in such a content distribution system and method.

In order to accomplish the above-mentioned objects, the present invention provides a content creation apparatus which comprises: a classification device that classifies a supplied text data set into any one of a plurality of categories in accordance with substance of the supplied text data set; a music selection device that selects or generates a musical composition data set which corresponds to the category of the text data set classified by the classification device; and a content information generation device that generates content information containing first position information indicative of a stored position of the supplied text data set and second position information indicative of a stored position of the selected or generated musical composition data set.

The present invention also provides a content distribution system which comprises: a server that distributes, via a communication network, content information that contains first position information indicative of a stored position of a text data set and second position information indicative of a stored position of a musical composition data set; and a client terminal that receives the content information distributed from the server via the communication network, accesses, on the basis of the first position information contained in the received content information, a first predetermined position, on the communication network, corresponding to the first position information, so as to receive the text data set distributed from the first predetermined position, and accesses, on the basis of the second position information contained in the received content information, a second predetermined position, on the communication network, corresponding to the second position, so as to receive the musical composition data set distributed from the second predetermined position.

The present invention also provides a communication terminal apparatus which comprises: a receiver that receives content information distributed via a communication network, the content information containing first position information indicative of a stored position of a text data set and second position information indicative of a stored position of a musical composition data set; and a transmitter that, on the basis of the first position information contained in the content information received via the receiver, automatically connects to a first predetermined position, on the communication network, corresponding to the first position information so that the transmitter receives the text data set distributed from the first predetermined position, and that, on the basis of the second position information contained in the received content information, automatically connects to a second predetermined position, on the communication network, corresponding to the second position information so that the transmitter receives the musical composition data set distributed from the second predetermined position.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the objects and other features of the present invention, its embodiments will be described in greater detail hereinbelow with reference to the accompanying drawings, in which.

DETAILED DESCRIPTION OF EMBODIMENTS

Figure 1:
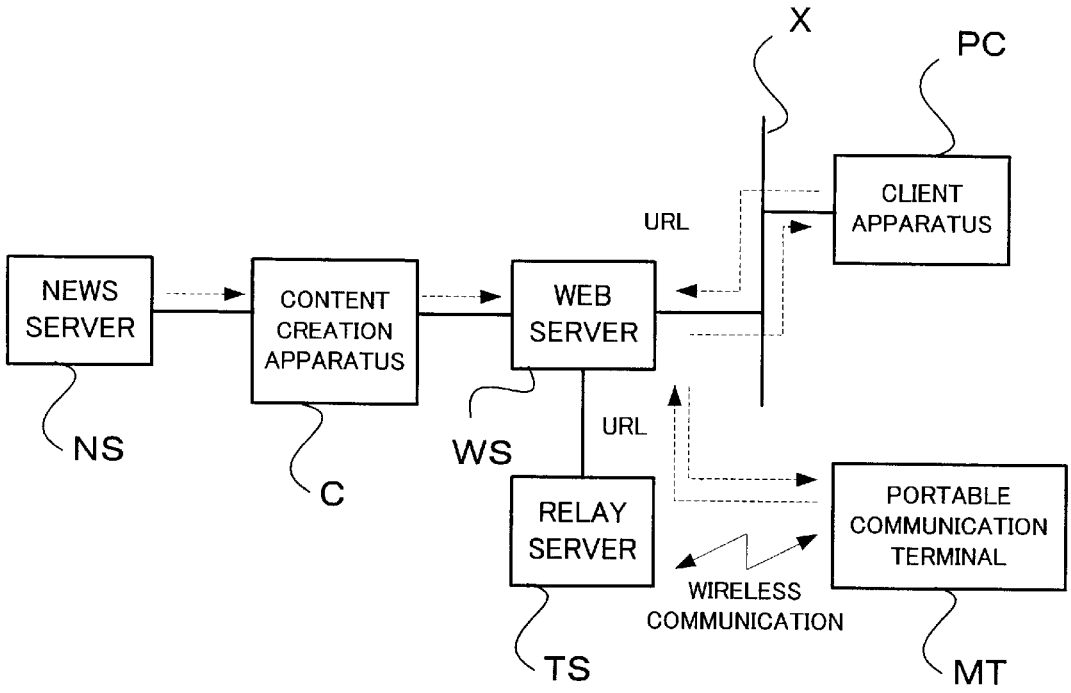
FIG. 1 is a block diagram showing a general setup of a content distribution system in accordance with an embodiment of the present invention.

The embodiments to be described in detail hereinbelow are designed to create and distribute "content" that has imparted thereto a music piece fitting or suiting the substance or contents—hereinafter, the term "substance" rather than the term "contents" is used to clearly differentiate from the term "content" that is used to mean information to be created and distributed in the present invention—of news, weather forecast or other information, so that any interested user is allowed, on the basis of the distributed "content", to view the news, weather forecast or other information, visually displayed in text form, while listening to BGM sounds fitting the substance of the news, weather forecast or other information.

Functions of a content creation apparatus in accordance with an embodiment of the present invention are first outlined as follows. The content creation apparatus comprises: a classification section for classifying a supplied text data set into any one of a plurality of categories in accordance with the substance of the supplied text data set; and a music selection/generation section for selecting or generating a musical composition data set which corresponds to the classified category of the supplied text data set. The content creation apparatus associates the selected or generated musical composition data set with the supplied text data set, to thereby provide "content" comprising a combination of the text data set and musical composition data set.

The content creation apparatus thus arranged can provide content that contains the supplied text data and musical composition data associated with or corresponding to the substance of the supplied text data. Namely, once a given text data set is supplied to the content creation apparatus of the invention, the classification section determines, on the basis of the substance of the supplied text data set, which one of a plurality of categories the supplied text data set belongs to, to thereby categorize the text data set. The music selection/generation section is arranged to select one of a plurality of musical composition data sets which corresponds to the identified category of the supplied text data set, or generate such a musical composition data set corresponding to the identified category of the supplied text data set. Namely, with the inventive arrangement that the supplied text data set is categorized by the classification section and a particular musical composition data set is selected or generated by the music selection/generation section in accordance with the identified category of the supplied text data set, the particular musical composition data set can be effectively related to or associated with each supplied text data set. Because a particular musical composition data can be associated with each supplied text data set in accordance with the substance of the supplied text data set like this, it is possible to provide, for each supplied text data set, content comprising a combination of the text data and musical composition data fitting the substance of the text data.

Further, a content distribution system in accordance with an embodiment of the present invention comprises: a server for distributing "content" that contains a text data set and a musical composition data set associated with the text data set and fitting the substance of the text data set; and a client that receives the content from the server via a communication network. Because the content distributed from the server via the communication network is made up of a text data set and a musical composition data set fitting the substance of the text data set as noted above, the client can always receive such content that contains not only a text data set but also a musical composition data set appropriately fitting the text data set.

Further, a content reproduction apparatus in accordance with an embodiment of the present invention comprises: a receiver for receiving "content" that contains a text data set and a musical composition data set associated with the text data set and fitting the substance of the text data set; and a player for visually displaying the text data contained in the received content and also audibly reproducing the musical composition data in the same received content. By thus receiving content that contains a text data set and a musical composition data set associated with the text data set and fitting the substance of the text data set and audibly reproducing the musical composition data along with the visual display of the text data, any interested user is allowed to view the displayed text data while listening to BGM sounds fitting the substance of the displayed text data.

FIG. 1 is a block diagram showing a general setup of a content distribution system in accordance with an embodiment of the present invention. As shown, the content distribution system is made up of a news server NS, a content creation apparatus C, a Web server WS, a relay server TS, a communication network X, and a client terminal apparatus PC, and a portable communication terminal apparatus MT. As will be later described in detail, each of the various components or apparatus (i.e., the news server NS, content creation apparatus C, Web server WS, relay server TS, client terminal apparatus PC and portable communication terminal apparatus MT) constituting the content distribution system comprises an independent or stand-alone computer that includes a CPU, a ROM, a RAM, a communication interface, etc. Thus, each of the various components or apparatus in the system can transmit or receive various data (such as a table of contents, musical composition data, digested text data, voice data, detailed text data, etc. that will be described later), via the communication network X and/or dedicated communication line.

Note that the content distribution system of the present invention may of course include other hardware components than the above-mentioned, but a description will be made hereinbelow in relation to a case where only minimum necessary resources are employed.

The news server NS in the content distribution system is a server computer which is run, for example, by a predetermined newspaper publishing company, news agency or publishing company for the purpose of electronically mailing news to interested users. On a periodical (e.g., every ten minutes) or non-periodical basis, the news server NS electronically mails, to the content creation apparatus C, news, weather forecast or other information in a text data or HTML (HyperText Markup Language) format. Namely, the news server NS is connected with the content creation apparatus C via a dedicated line or communication network X such as the Internet. News electronically mailed from the news server NS to the content creation apparatus C includes digested text data and detailed text data. Note that the term "digested text data" refers to text data partly extracted from the detailed text data, or data indicative of the general purport or outline of the detailed text data. For each item of the electronically mailed or distributed news, the content creation apparatus C selects a music piece (i.e., musical composition data set), from among a multiplicity of prestored music pieces, which appropriately fits the substance of the mailed news. Also, the content creation apparatus C creates voice data corresponding to the digested text data and/or detailed text data. Further, the content creation apparatus C creates a predetermined table of contents by combining the selected musical composition data, created voice data, distributed digested text data and detailed text data. The musical composition data, voice data, digested text data, detailed text data and table of contents will be later described in detail.

The Web server WS is connected with the content creation apparatus C via a dedicated line or communication network X such as the Internet. The Web server WS stores a table of contents and various other data, such as musical composition data, voice data, digested text data and detailed text data, created by and sent from the content creation apparatus C, and delivers the table of contents and various other data to a content reproduction apparatus, such as client terminal apparatus PC or portable communication terminal apparatus MT, in response to access (e.g., designation of a uniform resource locator or URL) from the content reproduction apparatus. In the instant embodiment, the client terminal apparatus PC, which is a personal computer, has installed therein content-reproducing software. Because the Web server WS and client terminal apparatus PC are interconnected via the communication network X such as a LAN (Local Area Network), Internet or telephone line network, any interested user can communicate a table of contents and various other data with the Web server WS by connecting the client terminal apparatus PC to the communication network X; that is, two-way or bidirectional data communication is permitted between the Web server WS and the client terminal apparatus PC. Further, the client terminal apparatus PC can display the text data on the basis of the table of contents and various data received from the Web server WS and also can reproduce the content such as by playing back the musical composition data to produce background sounds. During the reproduction of the content, the client terminal apparatus PC can also reproduce the voice data of human voice or the like corresponding to the text data. Of course, the client terminal apparatus PC may be other than a personal computer, such as a dedicated content reproduction apparatus like an electronic bulletin board provided on the wall of a compartment of a "Shinkansen" or Superexpress train. Two or more such client terminal apparatus PC may be connected to the communication network X.

The portable communication terminal apparatus MT is a small-size terminal, such as a cellular phone or PDA (Personal Data (Digitall) Assistant), which is capable of wireless communication and has a content reproduction function in addition to its primary communication function. Thus, this portable communication terminal apparatus MT employed in the content distribution system can reproduce any desired content as with the above-mentioned client terminal apparatus PC. However, in a situation where the portable communication terminal apparatus MT is connected to the Web server WS for bidirectional communication between the portable communication terminal apparatus MT and the Web server WS, the relay server TS intervenes. Namely, by the relay server TS relaying signal transmission/reception between the portable communication terminal apparatus MT and the Web server WS, the portable communication terminal apparatus MT can transmit/receive a table of contents and various data to/from the Web server WS.

The client terminal apparatus PC, portable communication terminal apparatus MT, news server TS, Web server WS, relay server TS and content creation apparatus C each comprise a computer, which includes a CPU, a ROM, a RAM, a communication interface, etc. Each of the client terminal apparatus PC, portable communication terminal apparatus MT, news server TS, Web server WS, relay server TS and content creation apparatus C can transmit/receive a table of contents and various data via the communication network X, dedicated line or wireless communication facilities, independently of the others. Because the client terminal apparatus PC, portable communication terminal apparatus MT, news server TS, Web server WS, relay server TS and content creation apparatus C are very much similar to each other in hardware configuration, the following pages will describe an exemplary hardware setup of just a representative one of these system-constituting components or apparatus PC, MT, NS, WS, TS and C, with reference to FIG. 2 which is a block diagram showing an embodiment of the hardware setup of the representative one of the system-constituting components or apparatus.

In the instant embodiment, each of the system-constituting components or apparatus, i.e. client terminal apparatus PC, portable communication terminal apparatus MT, news server TS, Web server WS, relay server TS and content creation apparatus C, is controlled by a microcomputer that includes a microprocessor unit (CPU) 1, a read-only memory (ROM) 2 and a random access memory (RAM) 3. The CPU 1 controls operation of all elements in the system-constituting component or apparatus. To the CPU 1 are connected, via a data and address bus 1D, the read-only memory 2, random-access memory 3, operation detection circuit 4, display circuit 5, tone generator (T.G.) circuit 6, effect circuit 7, external storage device 9 and communication interface 10. Also connected to the CPU 1 is a timer 1A for counting various time periods and signaling predetermined interrupt timing for timer interrupt processes. Namely, the timer 1A generates tempo clock pulses for counting various time intervals and setting a tempo at which a music piece is to be automatically performed to produce BGM sounds. Frequency of the tempo clock pulses is adjustable via an panel operator unit 4A including various switches, operators, etc. Such tempo clock pulses generated by the timer 1A are given to the CPU 1 as processing timing instructions or as interrupt instructions. The CPU 1 carries out various processes in accordance with such instructions. The various processes carried out by the CPU 1 in the instant embodiment include a screen display process, an automatic performance process for automatically performing a selected music piece as BGM sounds, and so on.

Note that the news server TS, Web server WS, relay server TS and content creation apparatus C each need not necessarily include the tone generator (T.G.) circuit 6, effect circuit 7 and sound system 8. Further, the portable communication terminal apparatus MT need not necessarily include an external storage device 9. Furthermore, each of the above-mentioned system-constituting components or apparatus need not necessarily be a dedicated apparatus and may be a general-purpose apparatus, such as a personal computer, multimedia equipment, or the like. Namely, the above-mentioned system-constituting components or apparatus may be of any type as long as they are constructed to create, distribute an reproduce content using predetermined software or hardware configuration based on the present invention.

The ROM 2 stores therein various programs to be executed by the CPU 1 and various data. The RAM 3 is used as a working memory for temporarily storing various content information regarding text content to be visually displayed and music pieces to be performed or audibly reproduced as BGM sounds (e.g., table of contents, musical composition data, voice data, digested text data and detailed text data), music information for automatic performance, and various data occurring as the CPU 1 executes programs. The RAM 3 is also used for storing a currently-executed program and data related to the currently-executed program. Further, predetermined address regions are allocated to various functions so as to be used as registers, flags, tables and other types of memories.

The panel operator unit 4A includes various types of operators, such as switches, for designating a desired table of contents, entering various musical conditions to automatically perform a desired music piece. Among such operators are a ten-button keypad for inputting numerical value data, keyboard for inputting character data, and panel switches. The panel operator unit 4A may also include operators for selecting, setting cond controlling a tone pitch, color, effect, etc. The detection circuit 4, connected with the panel operator unit 4A, constantly detects respective operational states of the individual operators on the operator unit 4A and outputs switch information, corresponding to the detected operational states of the operators, to the CPU 1 via the data and address bus 1D. The display circuit 5 visually displays various information, such as the digested text data, detailed text data or table of contents, on a display device 5A that may comprise an LCD (Liquid Crystal Display) or CRT (Cathode Ray Tube). Also, the display circuit 5 displays, on the display 5A, various music information of an automatic performance music piece, controlling states of the CPU 1, and the like.

The tone generator (T.G.) circuit 6, which is capable of simultaneously generating tone signals in a plurality of channels, receives musical composition data, voice data, etc. supplied via the data and address bus 1D and generates tone signals based on these received data. Each of the tone signals thus generated by the tone generator circuit 6 is audibly reproduced or sounded by the sound system 8 including amplifiers and speakers. The musical composition data, i.e. music performance data, may be in a digitally-coded data format such as the MIDI format or in a waveform sample data format such as the PCM, DPCM or ADPCM format. The effect circuit 7 imparts various effects to the tone signals thus generated by the tone generator circuit 6. The tone generator circuit 6 may generate such tone signals by any desired conventionally-known method, such as: the memory readout method where sound waveform sample value data stored in a waveform memory are sequentially read out in accordance with address data that vary in correspondence to the pitch of a tone to be generated; the FM method where sound waveform sample value data are obtained by performing predetermined frequency modulation operations using the above-mentioned address data as phase angle parameter data; or the AM method where sound waveform sample value data are obtained by performing predetermined amplitude modulation operations using the above-mentioned address data as phase angle parameter data. Other than the above-mentioned, the tone generator circuit 6 may also use the physical model method, harmonics synthesis method, formant synthesis method, analog synthesizer method using a combination of VCO, VCF and VCA, or analog simulation method. Further, the tone generator circuit 6 may be implemented by a combined use of a DSP and microprograms or of a CPU and software programs, rather than by use of dedicated hardware. Furthermore, the plurality of tone generating channels may be implemented by using a single circuit on a time-divisional basis, or each of the plurality of tone generating channels may be implemented by a separate circuit.

The external storage device 9 is provided for storing tables of contents, musical composition data, voice data, digested text data, detailed text data, and data related to various programs to be run by the CPU 1. Where a desired control program is not prestored in the ROM 2, the desired control program may be prestored in the external storage device (e.g., hard disk device) 9, so that, by reading out the desired control program from the external storage device 9 into the RAM 3, the CPU 1 is allowed to operate in exactly the same way as in the case where the desired control program is stored in the program memory (ROM) 2. This arrangement greatly facilitates version upgrade of the control program, addition of a new control program, etc. Note that the external storage device 9 may comprise any one or more of various removable-type media rather than the hard disk (HD), such as a floppy disk (FD), compact disk (CD-ROM or CD-RAM), magneto-optical disk (MO), digital versatile disk (DVD) and semiconductor memory.

Further, the communication interface 10 is connected to a communication network 10B (network X), such as a LAN, Internet or telephone line network, via which it may be connected to a predetermined computer such as a Web sever WS so as to input a program and various data from the computer to the apparatus in question. Thus, in a situation where a given control program and various data for reproducing content are not contained in the ROM 2, the external storage device (e.g., hard disk) 9 or the like, the control program and various data can be downloaded from the Web server WS via the communication interface 10. In the case of the client terminal apparatus PC, it sends, via the communication interface 10 and communication network 10B (X), a command to request the Web server WS to download the control program and various data. In response to the command from the client terminal apparatus PC, the Web server WS delivers the requested control program and various data to the client terminal apparatus PC via the communication network 10B (X). In turn, the client terminal apparatus PC receives the control program and various data to thereby accumulatively store them into the external storage device (e.g., hard disk) 9 or the like, which completes the necessary downloading operations. Note that the communication interface 10 and communication network X may be of a wired or wireless type; in an alternative, wired- and wireless-type communication interfaces 10 and communication networks X may be provided in the instant embodiment.

Figure 3:
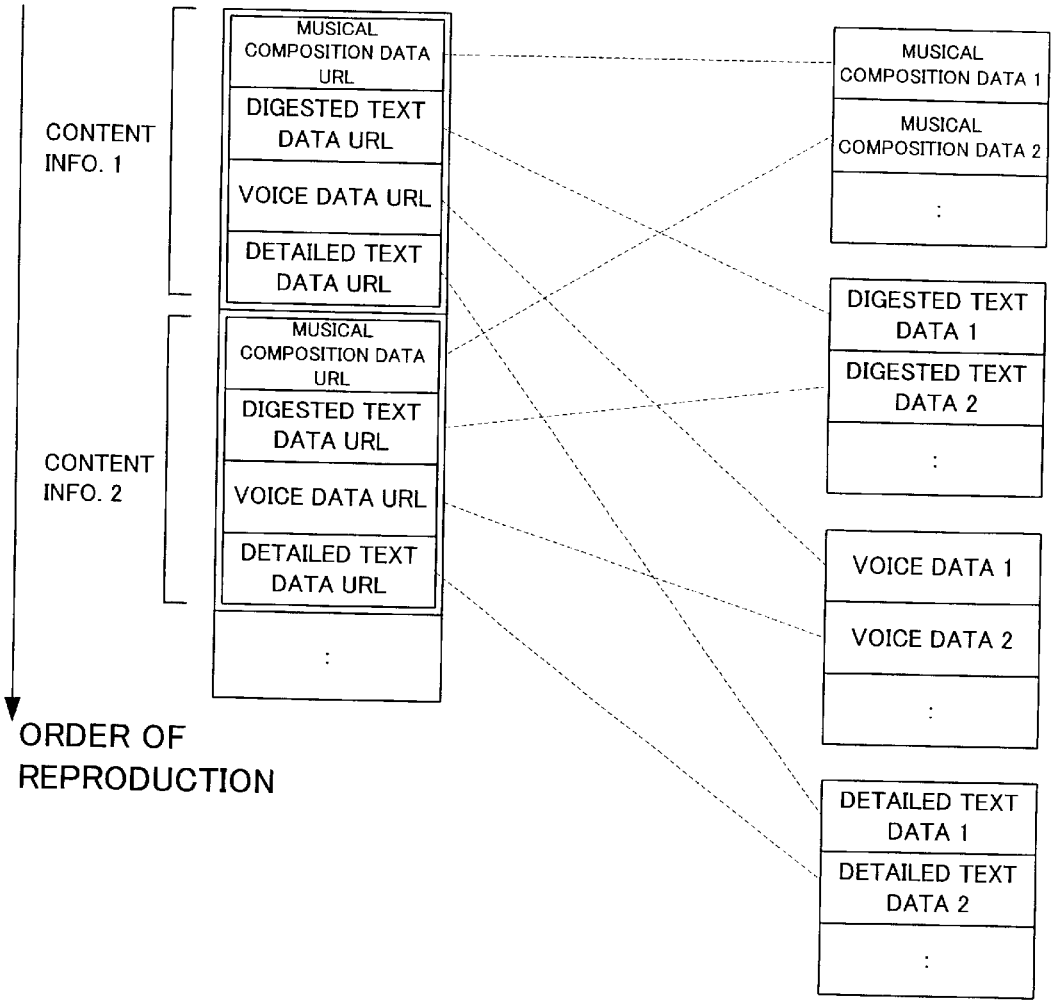
FIG. 3 is a diagram conceptually showing an example of a table of contents employed in the content distribution system of FIG. 1.

The following paragraphs briefly describe the above-mentioned table of contents, musical composition data, voice data, digested text data and detailed text data. FIG. 3 is a diagram conceptually showing an example of the table of contents, musical composition data, voice data, digested text data and detailed text data, in which the table of contents is shown on the left portion while the musical composition data, voice data, digested text data and detailed text data corresponding to the table of contents are shown on the right portion.

The table of contents is created by the content creation apparatus C and delivered from the content creation apparatus C to the Web server WS to be stored therein. The table of contents is stored as a combination of URLs (Uniform Resource Locators), for each content information (content information 1, content information 2, . . . ), serving as indices pointing to the musical composition data, voice data, digested text data and detailed text data. The URL, which indicates a stored position of the data in question, is an address (e.g., Internet address) which permits access from each of the client terminal apparatus PC and portable communication terminal apparatus MT to the data of interest stored in the Web server WS located on the communication network X. In FIG. 3, correspondency between the URLs contained in the table of contents and the respective data is shown by dotted lines for convenience of illustration.

As seen in FIG. 3, the table of contents comprises a plurality of pieces of content information (content information 1, content information 2, . . . ) each including a set of "musical composition data URL", "digested text data URL", "voice data URL" and "detailed text data URL". The plurality of pieces of content information are stored in corresponding relation to different categories, such as political news, economic news, local news, sports news and weather forecast, in order in which the individual data or contents are to be reproduced. For example, where one news distribution (i.e., news distributed on a single occasion) begins with political news, proceeds to economic news, local news and then sports news, and then ends with a weather forecast, these news and weather forecast are stored in the table of contents in the mentioned order; that is, a first set of pieces of content information (content information 1) in the table of contents represents political news, a second set of pieces of content information (content information 2) represents economic news, a third set of pieces of content information (not shown) represents local news, a fourth set of pieces of content information (also not shown) represents sports news, a fifth set of pieces of content information (also not shown) represents a weather forecast, and so on.

The "musical composition data URL" is information designating a stored position of a musical composition data set in the Web server WS. The musical composition data set corresponding to the musical composition data URL comprises music data of a music piece to be performed as BGM sounds, such as performance data (which may be incoming-call alerting melody data for the portable communication terminal apparatus) in the MIDI format or the like, compressed or non-compressed audio data or the like.

The "digested text data URL" is information designating a stored position of a digested data set in the Web server WS. The digested data set corresponding to the digested text data URL is information indicating a digest of news, such as a headline or outline of distributed news. For example, in a case where the category of the content information in question is political news and one political news distribution (i.e., political news distributed on a single occasion) begins with domestic political news, proceeds to political news of various foreign countries, and then ends with other political news, digests of these news are stored in the digested text data set in the mentioned order.

The "voice data URL" is information designating a stored position of a voice data set in the Web server WS. The voice data set corresponding to the voice data URL comprises voice data (i.e., compressed or non-compressed voice waveform sample data) created on the basis of the digested text data. It should be appreciated that in a situation where the client terminal apparatus PC or portable communication terminal apparatus MT includes a voice synthesis section (to be described later), the voice data set may comprise other data than the voice waveform sample data, such as digitally-coded voice data for driving the voice synthesis section to synthesize desired voice waveform samples.

The "detailed text data URL" is information designating a stored position of a detailed text data set in the Web server WS. The detailed text data set corresponding to the detailed text data URL represents the body of the distributed news. The detailed text data set may comprises not only simple text data but also data imparted with decorative information indicative of a font, size, color and other ornaments (e.g., HTML tag) of letters used. In addition to the text data, the detailed text data set may include still image data of a photograph or the like, or moving (animated) image data of a motion picture or the like. In such a case, the image data may be stored separately from the detailed text data, and an URL to the image data may be described in the detailed text data.

Further, in the example of FIG. 3, the URLs included in each of the pieces of content information need not necessarily represent different data sets; that is, a same data set may be represented by the URLs in two or more of the pieces of content information. For example, the musical composition data URL in the first content information (content information 1) and the musical composition data URL in the second content information (content information 2) may represent a same musical composition data set, e.g. "musical composition data set 1".

Figure 2:
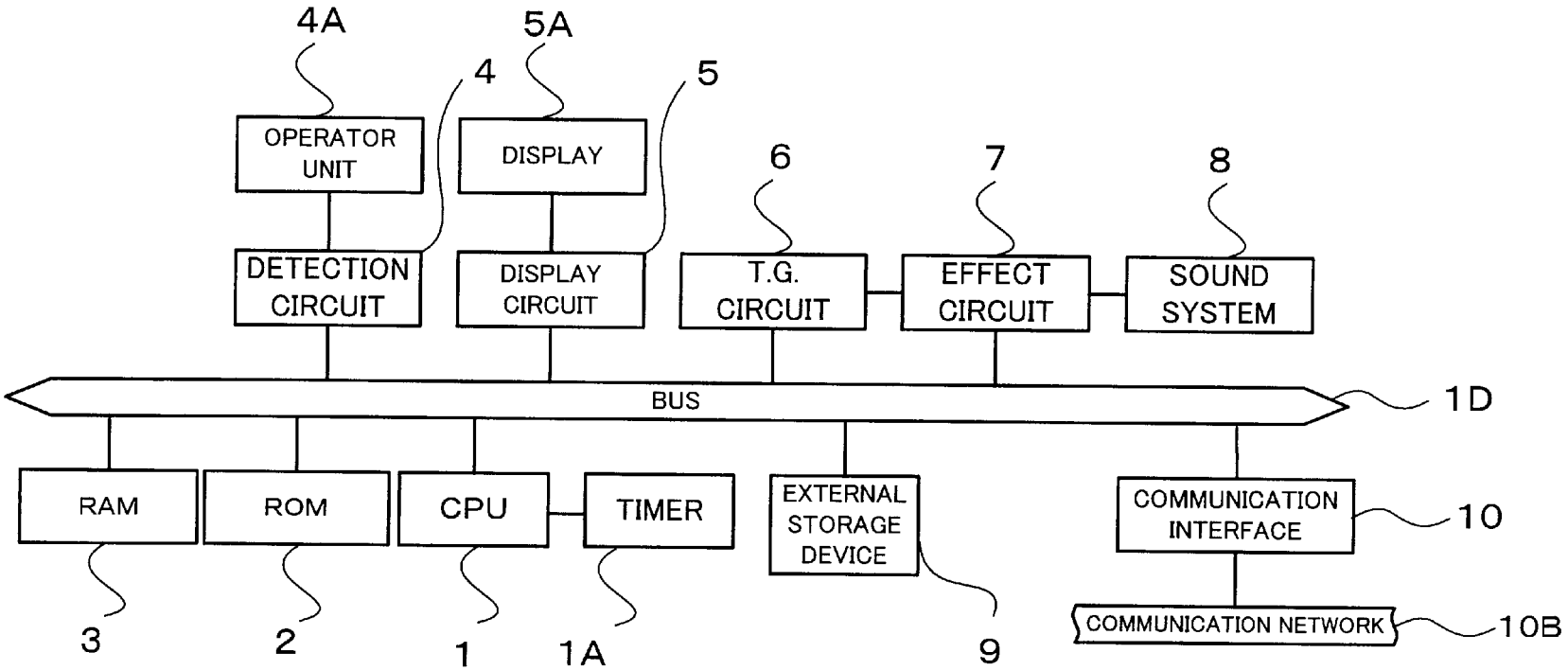
FIG. 2 is a block diagram showing an embodiment of a general hardware setup of a representative one of the components or apparatus constituting the content distribution system shown in FIG. 1.

Next, a description will be made about an embodiment of the content creation apparatus C for creating the above-mentioned content table in the content distribution system of the invention, with reference to a block diagram of FIG. 40. Note that this content creation apparatus C may be either based on a computer as shown in FIG. 2 (i.e., of a type where the CPU 1 or general-purpose processor executes a predetermined program) or arranged as a dedicated apparatus. In the latter case, the content creation apparatus C includes devices or sections for performing respective processes and/or functions of individual blocks as shown in FIG. 4.

Figure 4:
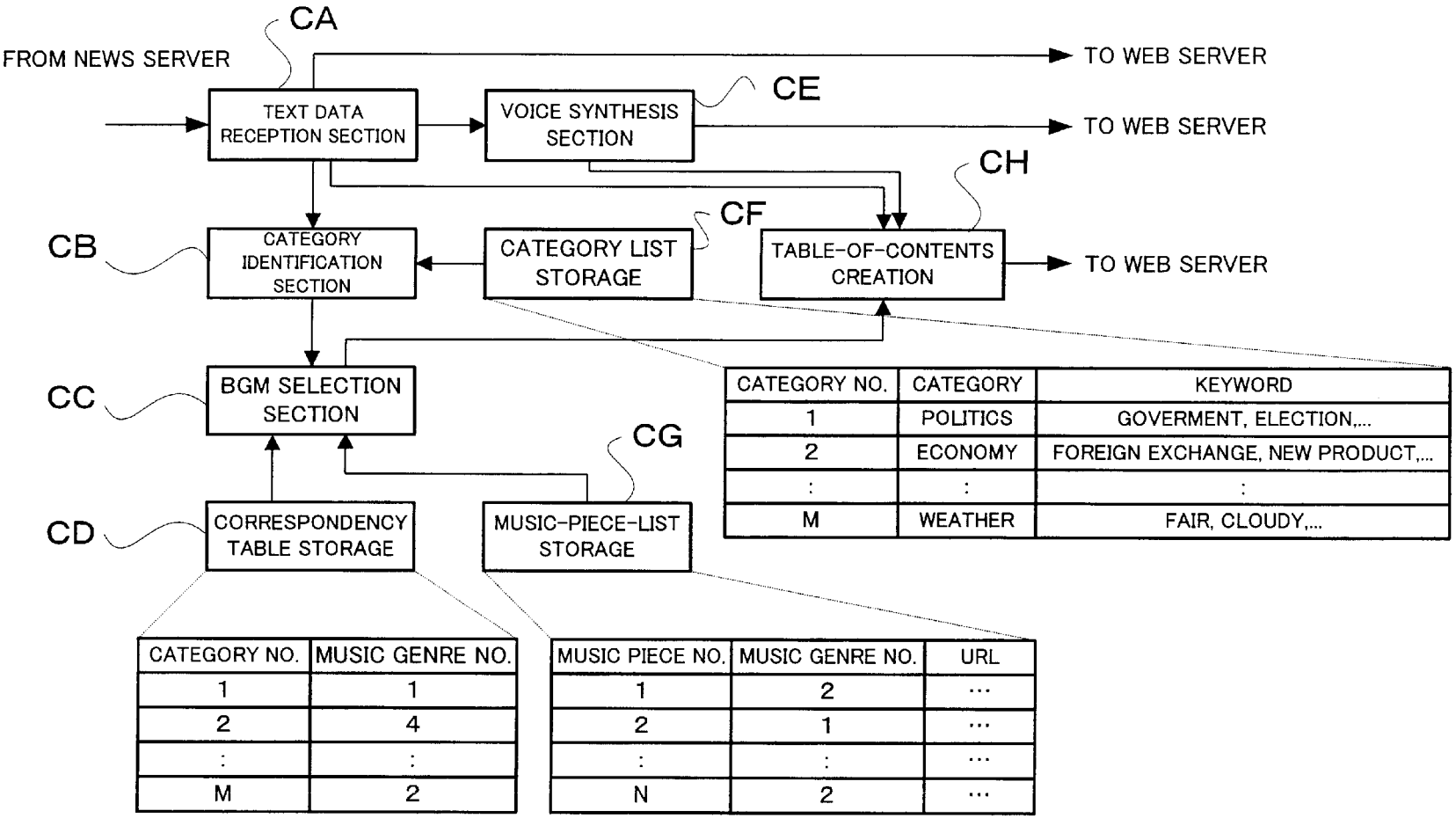
FIG. 4 is a block diagram showing a specific embodiment of a content creation apparatus for creating the table of contents in the content distribution system of FIG. 1.

In FIG. 4, a text data reception section CA receives digested text data and detailed text data sets from the news server NS. The digested text data and detailed text data sets may be distributed either separately (in this case, correspondency between the digested text data and detailed text data sets is described in either one of the sets) or together in a single combined set. Each item of news may be distributed as a single electronic mail, or a plurality of items of news may be distributed as a single electronic mail in a mixed fashion. In the case where a plurality of items of news are distributed as a single electronic mail in a mixed fashion, the plurality of items of news are separated from each other after reception by the text data reception section CA. The thus-received digested text data and detailed text data are then transmitted to the Web server WS to be registered therein. The individual URLs of the data thus registered (i.e., digested text data URL and detailed text data URL) are routed to a table-of-contents creation section CH.

On the basis of the digested text data received by the text data reception section CA, the voice synthesis section CE synthesizes voice data corresponding to the substance of the received digested text data. The voice data may be synthesized using any suitable scheme, such as the conventional formant synthesis scheme. The thu synthesized voice data are transmitted to the Web server WS to be registered therein. The URL of the voice data thus registered (i.e., voice data URL) is routed to a table-of-contents creation section CH.

Category identification section CB identifies the category of the digested text data and/or detailed text data received by the text data reception section CA, and determines a category number of the received data. Namely, the category identification section CB obtains the category number of the data, by referring to a category list storage section CF on the basis of keywords contained in the digested text data and/or detailed text data; the category number of the data is automatically determined on the basis of the frequency of occurrence (i.e., incidence) of the keywords within the received digested text data or detailed text data. More specifically, the category list storage section CF has prestored therein a category table where a plurality of keywords are contained in association with each of predetermined category numbers or categories. Thus, the category identification section CB determines, as the category number of the digested text data and/or detailed text data, a specific one of the category numbers or categories in the table for which the frequency of occurrence of the keywords is greater. For example, if keywords "government", "election" and "foreign exchange" occur three times, twice and four times, respectively, in the digested text data, then the category of the digested text data is judged to be "politics", and "1" is determined as the category number. It should be obvious that the category may be identified in any other manner than the above-mentioned. For example, the category may be identified by a human operator examining the substance of the digested text data or detailed text data, or some data indicative of the category or category number may be previously incorporated in the digested text data or detailed text data of the news. In such cases, the above-mentioned category identification section CB and category list storage section CF may of course be omitted.

BGM selection section CC determines a music-piece genre number corresponding to the category number determined by the category identification section CB, by referring to a correspondency table storage section CD on the basis of the category number. The correspondency table storage section CD has prestored therein a correspondency table where music-piece genre numbers are stored in association with various category numbers. In the correspondency table, the music-piece genre numbers and category numbers may correspond to each other on a one-to-one basis, or each one of the music-piece genre numbers may correspond to two or more category numbers; conversely, each one of the category numbers may correspond to two or more music-piece genre numbers. The instant embodiment is described herein in relation to the case where the music-piece genre numbers and category numbers correspond to each other on the one-to-one basis. Further, the BGM selection section CC randomly selects any one of a plurality of music piece numbers corresponding to the determined music-piece genre number, with reference to a music-piece-list storage section CG, and then obtains an URL corresponding to the selected music piece number. The music-piece-list storage section CG has prestored therein a music piece list table where the music piece numbers and URLs are contained in association with the music-piece genre numbers. The thus-obtained URL indicating a musical composition data set (i.e., musical composition data URL) is given to the table-of-contents creation section CH.

In this way, the table-of-contents creation section CH creates a table of contents comprising sets of the digested text data URL, detailed text data URL, musical composition data URL and voice data URL that are arranged in a predetermined displayed order in which the items of the news are to be displayed (i.e., reproduction order of the music pieces). Whenever new news is received by the text data reception section CA, the table-of-contents creation section CH creates a new table of content by adding the URLs of the various data corresponding to the newly received news. Note that the number of the items of the news accumulated in the thus-created table of contents may be predetermined or unlimited. In an alternative, the number of the items of the news to be accumulated in the table of contents may be limited by the time; for example, only the items of the news distributed for the last two hours or for the day may be accumulated in the table of contents. In another alternative, a plurality of such table of contents, limited in the number of the accumulated items of the news according to the predetermined number or time, may be stored in the Web server WS so that any desired one of the stored tables of contents can be selectively accessed by a content reproduction apparatus such as the client PC or portable communication terminal apparatus MT. In another modification, a separate table of contents may be created for each of the categories (e.g., for each of political news, economic news, local news, sports news and weather forecast), or for each of a plurality of news distributors, such as newspaper publishing companies. In such cases where a plurality of the tables of contents are created, the client terminal apparatus PC or portable communication terminal apparatus MT is designed to select any desired one of the table of contents.

Figure 5:
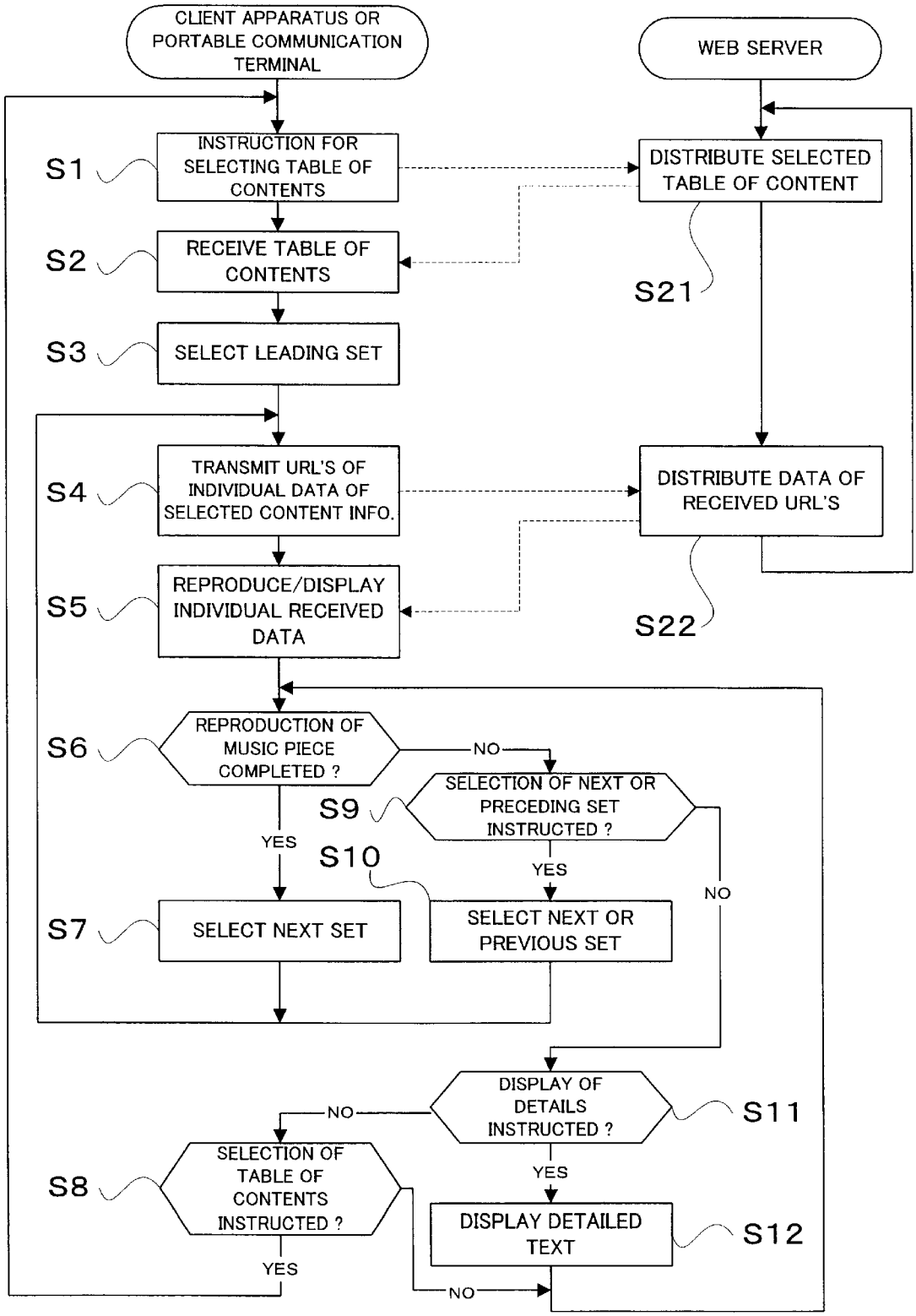
FIG. 5 is a flow chart showing an example of content reproduction processing carried out by the content reproduction apparatus in the content distribution system of the present invention.

FIG. 5 is a flow chart showing an example of content reproduction processing carried out in the content reproduction apparatus of the present invention. Specifically, FIG. 5 shows content reproduction processes carried out by the content reproduction apparatus, such as the client terminal apparatus PC or portable communication terminal apparatus MT, and by the Web server WS.

In the content reproduction processing of FIG. 5, the user of the client terminal apparatus PC or portable communication terminal apparatus MT, at step S1, first gives an instruction for selecting a desired one of the table of contents, in order to reproduce the individual data. For example, a listing of the table of contents is shown on the display 5A so that the user can select a desired one of the displayed tables of contents created for various news distributors (e.g., news by "ABC" news publishing company and news by "XX" news publishing company) or for various categories (e.g., political news, economic news, local news, sports news, and weather forecast). The table of contents selected by the user is informed from the content reproduction apparatus to the Web server WS. In turn, the Web server WS reads out the selected table of contents from the external storage device 9 and distributes the thus read-out table of contents to the content reproduction apparatus, at step S21. Upon receipt of the table of contents distributed from the Web server WS, the content reproduction apparatus stores the table of contents into a predetermined storage area of the RAM 3 or the like, at step S2. Then, the user gives an instruction for selecting a particular content information from among the plurality of content information contained in the received table of contents, at step S3.

At next step S4, the respective URLs of the individual data sets belonging to the selected content information from the table of contents (i.e., digested text data set, detailed text data set, musical composition data set and voice data set) are transmitted to the Web server WS. The URL transmission to the Web server WS is automatically performed in response to the selection of the content information at step S3; however, it may of course be performed in response to a user's transmission instruction. Then, at step S22, the Web server WS sequentially reads out the individual data corresponding to the URLs from respective storage positions indicated by the URLs, and distributes the read-out data to the content reproduction apparatus. At that time, the thus read-out data may be distributed in data files or in streams with the data divided into packets. The content reproduction apparatus displays/reproduces each of the data received from the Web server, at step S5. In displaying the digested text data, the data may be visually displayed collectively on the display 5A if the display 5A has a large displaying area, or only some of the data may be visually displayed at one time if the display 5A has a small displaying area. In the latter case, the displaying area may be scrolled in a vertical or horizontal direction, or only some of the data may be displayed for a predetermined time and then erased so that others of the data can be displayed on the displaying area in place of the preceding (erased) data. The musical composition data are reproduced as BGM sounds along with the visual display of the corresponding digested text data, at the same time of which the corresponding voice data are reproduced. This way, the user is allowed to pleasantly read the digest of the news while listening to the BGM sounds, with the result that the user can understand the substance of the news without having to carefully view the displayed news. Note that the detailed text data will not be displayed unless a specific instruction (details display instruction) is given (see step S11 to be described later). Further, the user may decide whether or not the voice data should be reproduced.

At following step S6, a determination is made as to whether the reproduction of the musical composition data has been completed or not. If answered in the affirmative at step S6, the next content information is automatically selected at step S7. Then, the content reproduction apparatus reverts to step S4, in order to reproduce the selected content information by repeating the operations of steps S4 to S6. If, on the other hand, the reproduction of the musical composition data has not been completed as determined at step S6, a determination is made, at step S9, as to whether or not the user has given an instruction for selecting the next or preceding set of pieces of content information. With an affirmative (YES) determination at step S9, the content reproduction apparatus selects the next or preceding content information at step S10 and then reverts to step S4, in order to reproduce the selected next or preceding content information by repeating the operations of steps S4 to S6. In case the user has not given any instruction for selecting the next or preceding content information (NO determination at step S9), the content reproduction apparatus moves on to step S11. In this way, the next or preceding content information can be selected before the reproduction of the current musical composition data is completed, and the musical composition data to be reproduced can be changed in accordance with the selection instruction. Thus, the user is allowed to skip the remaining portion of the BGM corresponding to the news which the user has finished viewing (and listening to) the news, so as to quickly view the next news or again view (and listen to) the preceding news.

As step S11, it is determined whether or not a display of the details has been instructed or not. If answered in the affirmative at step S11, the detailed text data are displayed on the display 5A at step S12, and then the content reproduction apparatus reverts to step S6. In the case where the content reproduction apparatus comprises a personal computer, the detailed text data are displayed, for example, via a Web browser. It should be appreciated that pictures or images may be displayed in addition to the characters. Advertisement may be displayed along with the detailed text data, and the display of the detailed text data may be followed by a display for electronic business transaction, such as sale of the musical composition data played as BGM sounds, or a musical score or CD corresponding to the musical composition data. In the case where some advertisement is displayed, the content distribution service can be provided at a low price or free of charge because of the advertising revenue. Also, advertisers may be invited by the same display.

If there have been no instructions for making a detailed display and selecting a table of contents (no determinations at both steps S11 and S8), the content reproduction apparatus loops back to step S6. If, however, there has been no instruction for making a detailed display but there has been an instruction for selecting a table of contents has been instruction (no determination at step S11 but YES determination at step S8), the content reproduction apparatus loops back to step S4. Namely, another table of contents is selected in response to the selection instruction, so that the content to be displayed and reproduced is changed; for example, news by "ABC" news publishing company is changed to news by "XX" news publishing company, or political news is changed to sports news.

Whereas each of the table of contents has been described above as defining correspondency or corresponding relationship between the content information indicating a plurality of kinds of data to be created, distributed and reproduced and the various contents (see FIG. 3), a set of data containing a plurality of kinds of contents may be created, distributed and reproduced. For example, text data and voice data may be incorporated in musical composition data of the MIDI format and incoming-call alerting melody data for the portable communication terminal apparatus MT.

The content information is not necessarily limited to that of news and may represent any other information, such as information about a novel, relay broadcasting of sports, and various information about foods and entertainment, etc. Further, the categories need not be specific ones corresponding to news and may be rather abstract ones represented by adjectives such as "pleasant", "quiet", "dark" and "bright".

In the case where the content information represents news, the detailed text data and voice data need not necessarily be created, distributed and reproduced, and it is only necessary to provide data for displaying and reproducing at least the digest of the news and music piece as BGM.

Further, although the present invention has been described above as selecting another or next table of contents only when there has been received an instruction from the content reproduction apparatus (client terminal apparatus PC or portable communication terminal apparatus MT), the other or next table of contents may be automatically selected as soon as the reproduction of all the data represented by the preceding table of contents has been completed. Furthermore, once the currently-reproduced table of contents has been updated in the Web server WS, the latest table of contents may be automatically distributed to the content reproduction apparatus.

It should also be appreciated that the function of the content creation apparatus C may be performed by the content reproduction apparatus. For example, the content reproduction apparatus itself may be arranged to receive text data of electronically mailed news etc., identify the category of the text data on the basis of the substance of the received text data, and reproduce any one of a multiplicity of musical composition data sets, stored in the content reproduction apparatus, along with the visual display of the text data fitting the identified category.

Furthermore, the embodiments of the present invention have been described above in relation to the case where the respective URLs of the individual data are contained in the table of contents and the content reproduction apparatus, upon receipt of the table of contents, accesses the Web server in accordance with the URLs to sequentially receive the individual data from the Web server; however, the present invention is not so limited. For example, the individual data themselves may be contained in the table of contents and the content reproduction apparatus may be arranged to, upon receipt of the table of contents, receive the individual data in a collective fashion. However, the arrangement that the individual data are received from the Wen server WS in accordance with the URLs as in the above-described embodiments is more advantageous in that it can reduce the necessary storage capacity of the content reproduction apparatus and thereby minimize the size of the content reproduction apparatus. Further, where the client terminal apparatus PC possesses musical composition data sets, any musical composition data designated by the table of contents may be read out and reproduced from the client terminal apparatus PC as long as the designated musical composition data are stored in the database of the client terminal apparatus PC.

Moreover, the present invention is not necessarily limited to the arrangement that a multiplicity of musical composition data sets of complete music pieces are prestored for selection of a desired one of the musical composition data sets. Parameters for music composition may be generated or selected in accordance with the category of the text data so that a music piece fitting the category is automatically produced. Namely, such music composing parameters are included in the concept or meaning of the musical composition data of the present invention. Moreover, the number of the Web server including at least one of the sets of digested text data, detailed text data, musical composition data and voice data may be either just one or two or more; namely, the sets of digested text data, detailed text data, musical composition data and voice data may be stored in separate Web servers, such as a musical composition data server, text data server, and so on.

In a situation where the content reproduction apparatus is applied to an electronic musical instrument, the electronic musical instrument may be other than a keyboard type, such as a stringed instrument, wind instrument or percussion instrument type. It should also be appreciated that the electronic musical instrument is not limited to the type where the tone generator device, automatic performance device, etc. are incorporated together within the body of the electronic musical instrument, and may be of another type where the tone generator device, automatic performance device, etc. are provided separately from each other but can be connected with each other via MIDI interfaces and communication facilities such as a communication network. Further, the electronic musical instrument may comprise a combination of a personal computer and application software, in which case various processing programs may be supplied from a storage medium, such as a magnetic disk, optical disk or semiconductor memory or via a communication network. Further, the content reproduction apparatus may be applied to an automatic performance apparatus such as a karaoke apparatus or player piano.

It should also be appreciated that where the musical composition data are MIDI performance data or the like, the musical composition data may be in any desired format, such as: the "event plus absolute time" format where the time of occurrence of each performance event is represented by an absolute time within the music piece or a measure thereof; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event.

Furthermore, where musical composition data sets for a plurality of channels are handled in the present invention, the musical composition data for the plurality of channels may be stored together in a mixture or the musical composition data sets for the channels may be separated from each other on a track-by-track basis.

In summary, the present invention is characterized in that each distributed text data set is classified into any one of a plurality of categories in accordance with the substance of the text data set, and a musical composition data set corresponding to the classified category is associated with the text data set, to thereby create content comprising the text data and musical composition data. With this inventive arrangement, the user is allowed to readily view each distributed text while listening to BGM sounds fitting the substance of the text, by only obtaining the created content.

Further, because the present invention can distribute content comprising text data and musical composition data stored in associated relation to each other, the user is allowed to readily obtain any desired content made up of text data and musical composition data fitting the substance of the text data.

Furthermore, because the present invention can supply content comprising text data and musical composition data stored in associated relation to each other and reproduce the musical composition data while visually displaying the text data contained in the supplied content, the user is allowed to readily view each distributed text while listening to BGM sounds fitting the substance of the text.

What is claimed is:

1. A content creation apparatus comprising:

a classification device that classifies a supplied text data set into any one of a plurality of categories in accordance with substance of the supplied text data set;

a music selection device that selects or generates a musical composition data set which corresponds to the category of the text data set classified by said classification device; and a content information generation device that generates content information containing first position information indicative of a stored position of the supplied text data set and second position information indicative of a stored position of the musical composition data set selected or generated by said music selection device.

2. A content creation apparatus as claimed in claim 1 which further comprises a transmitter that delivers, onto a communication network, the content information generated by said content information generation device.

3. A content creation apparatus as claimed in claim 1 wherein the text data set is a file of text data or a file of text and number data.

4. A content creation apparatus as claimed in claim 1 wherein each of the categories corresponds to a genre which the substance of the text data set belongs to.

5. A content creation apparatus as claimed in claim 1 wherein each of said first position information and said second position information is URL information.

6. A content creation apparatus comprising:

a classification device that classifies a supplied text data set into any one of a plurality of categories in accordance with substance of the supplied text data set; and a music selection device that selects or generates a musical composition data set which corresponds to the category of the text data set classified by said classification device, wherein said music selection device randomly selects a musical composition data set of any one of a plurality of music pieces which correspond to one of the categories.

7. A content creation apparatus comprising:

a classification device that classifies a supplied text data set into any one of a plurality of categories in accordance with substance of the supplied text data set; and a music selection device that selects or generates a musical composition data set which corresponds to the category of the text data set classified by said classification device, wherein said classification device searches the supplied text data set for predetermined keywords pertaining to individual ones of the categories and identifies the category of the supplied text data set on the basis of frequencies of occurrence of the keywords searched for within the text data set.

8. A content creation apparatus comprising:

a classification device that classifies a supplied text data set into any one of a plurality of categories in accordance with substance of the supplied text data set; and a music selection device that selects or generates a musical composition data set which corresponds to the category of the text data set classified by said classification device, wherein the musical composition data set selected or generated by said music selection device is associated with the supplied text data set, to thereby generate content that contains information representative of the text data set and information representative of the musical composition data set, and wherein one set of the content contains information representative of a plurality of text data sets to be sequentially reproduced and information representative of a plurality of musical composition data sets corresponding to the plurality of text data sets.

9. A content creation apparatus comprising:

a classification device that classifies a supplied text data set into any one of a plurality of categories in accordance with substance of the supplied text data set; and a music selection device that selects or generates a musical composition data set which corresponds to the category of the text data set classified by said classification device, wherein the musical composition data set selected or generated by said music selection device is associated with the supplied text data set, to thereby generate content that contains information representative of the text data set and information representative of the musical composition data set, and wherein one set of the content contains a plurality of text data sets, a plurality of musical composition data sets, and table data descriptive of correspondency between the text data sets and the musical composition data sets and order of reproduction of the text data sets and the musical composition data sets.

10. A content creation apparatus comprising:

a classification device that classifies a supplied text data set into any one of a plurality of categories in accordance with substance of the supplied text data set;

a music selection device that selects or generates a musical composition data set which corresponds to the category of the text data set classified by said classification device; and a voice data generation device that generates voice data corresponding to the supplied text data set.

11. A content distribution system comprising:

a server that distributes, via a communication network, content information that contains first position information indicative of a stored position of a text data set and second position information indicative of a stored position of a musical composition data set; and a client terminal that receives the content information distributed from said server via said communication network, accesses, on the basis of said first position information contained in the received content information, a first predetermined position, on said communication network, corresponding to said first position information, so as to receive the text data set distributed from said first predetermined position, and accesses, on the basis of said second position information contained in the received content information, a second predetermined position, on said communication network, corresponding to said second position, so as to receive the musical composition data set distributed from said second predetermined position.

12. A communication terminal apparatus comprising:

a receiver that receives content information distributed via a communication network, the content information containing first position information indicative of a stored position of a text data set and second position information indicative of a stored position of a musical composition data set; and a transmitter that, on the basis of said first position information contained in the content information received via said receiver, automatically connects to a first predetermined position, on said communication network, corresponding to said first position information so that said transmitter receives the text data set distributed from said first predetermined position, and that, on the basis of said second position information contained in the received content information, automatically connects to a second predetermined position, on said communication network, corresponding to said second position information so that said transmitter receives the musical composition data set distributed from said second predetermined position.

13. A communication terminal apparatus as claimed in claim 12 which further comprises a player that not only visually displays the text data set distributed from said first predetermined position but also audibly reproduces the musical composition data set distributed from said second predetermined position.

14. A communication terminal apparatus as claimed in claim 12 wherein the text data set is a file of text data or a file of text and number data.

15. A communication terminal apparatus as claimed in claim 12 wherein each of said first position information and said second position information is URL information.

16. A communication terminal apparatus as claimed in claim 13 wherein the content information contains a plurality of first position information indicative of stored positions of text data sets and a plurality of second position information indicative of stored positions of musical composition data sets, and wherein said player keeps on visually displaying one of the text data sets until reproduction of one of the musical composition data sets is terminated, and, in response to termination of the reproduction of the one musical composition data set, starts display of a next one of the text data sets and reproduction of a next one of the musical composition data sets.

17. A communication terminal apparatus as claimed in claim 13 wherein in the course of the reproduction, via said player, of the musical composition data set, display of a next or preceding text data set and reproduction of a next or preceding musical composition data set can be instructed.

18. A content creation method comprising:

a step of classifying a supplied text data set into any one of a plurality of categories in accordance with substance of the supplied text data set;

a step of selecting or generating a musical composition data set which corresponds to the category of the text data set classified by said step of classifying; and a step of generating content information that contains first position information indicative of a stored position of the supplied text data set and second position information indicative of a stored position of the musical composition data set selected or generated by said step of selecting or generating.

19. A content creation method comprising:

a step of classifying a supplied text data set into any one of a plurality of categories in accordance with substance of the supplied text data set; and a step of selecting or generating a musical composition data set which corresponds to the category of the text data set classified by said step of classifying, wherein said step of selecting or generating randomly selects a musical composition data set of any one of a plurality of music pieces which correspond to one of the categories.

20. A content creation method comprising:

a step of classifying a supplied text data set into any one of a plurality of categories in accordance with substance of the supplied text data set; and a step of selecting or generating a musical composition data set which corresponds to the category of the text data set classified by said step of classifying, wherein said step of classifying searches the supplied text data set for predetermined keywords pertaining to individual ones of the categories and identifies the category of the supplied text data set on the basis of frequencies of occurrence of the keywords searched for within the text data set.

21. A content creation method comprising:

a step of classifying a supplied text data set into any one of a plurality of categories in accordance with substance of the supplied text data set; and a step of selecting or generating a musical composition data set which corresponds to the category of the text data set classified by said step of classifying, wherein the musical composition data set selected or generated by said step of selecting or generating is associated with the supplied text data set, to thereby generate content that contains information representative of the text data set and information representative of the musical composition data set, and wherein one set of the content contains information representative of a plurality of text data sets to be sequentially reproduced and information representative of a plurality of musical composition data sets corresponding to the plurality of text data sets.

22. A content creation method comprising:

a step of classifying a supplied text data set into any one of a plurality of categories in accordance with substance of the supplied text data set; and a step of selecting or generating a musical composition data set which corresponds to the category of the text data set classified by said step of classifying, wherein the musical composition data set selected or generated by said step of selecting or generating is associated with the supplied text data set, to thereby generate content that contains information representative of the text data set and information representative of the musical composition data set, and wherein one set of the content contains a plurality of text data sets, a plurality of musical composition data sets, and table data descriptive of correspondency between the text data sets and the musical composition data sets and order of reproduction of the text data sets and the musical composition data sets.

23. A content creation method comprising:

a step of classifying a supplied text data s et into any one of a plurality of categories in accordance with substance of the supplied text data set;

a step of selecting or generating a musical composition data set which corresponds to the category of the text data set classified by said step of classifying; and a step of generating voice data corresponding to the supplied text data set.

24. A content distribution method comprising:

a step of distributing, via a communication network, content information that contains first position information indicative of a stored position of a text data set and second position information indicative of a stored position of a musical composition data set; and a step of receiving the content information distributed via said communication network;

a step of accessing, on the basis of said first position information contained in the content information received by said step of receiving, a first predetermined position, on said communication network, corresponding to said first position information, so as to receive the text data set distributed via said communication network, and a step of accessing, on the basis of said second position information contained in the received content information, a second predetermined position, on said communication network, corresponding to said second position information, so as to receive the musical composition data set distributed via said communication network.

25. A method for receiving and using content information comprising:

a step of receiving content information distributed via a communication network, the content information containing first position information indicative of a stored position of a text data set and second position information indicative of a stored position of a musical composition data set;

a step of, on the basis of said first position information contained in the content information received via said communication network, automatically connecting to a first predetermined position, on said communication network, corresponding to said first position information, so as to receive the text data set distributed via said communication network; and a step of, on the basis of said second position information contained in the received content information, automatically connecting to a second predetermined position, on said communication network, corresponding to said second position information, so as to receive the musical composition data set distributed via said communication network.

26. A machine-readable storage medium containing a group of instructions to cause said machine to implement a content creation method, said content creation method comprising:

a step of classifying a supplied text data set into any one of a plurality of categories in accordance with substance of the supplied text data set;

a step of selecting or generating a musical composition data set which corresponds to the category of the text data set classified by said step of classifying; and a step of generating content information that contains first position information indicative of a stored position of the supplied text data set and second position information indicative of a stored position of the musical composition data set selected or generated by said step of selecting or generating.

27. A machine-readable storage medium containing a group of instructions to cause said machine to implement a content creation method, said content creation method comprising:

a step of classifying a supplied text data set into any one of a plurality of categories in accordance with substance of the supplied text data set; and a step of selecting or generating a musical composition data set which corresponds to the category of the text data set classified by said step of classifying, wherein said step of selecting or generating randomly selects a musical composition data set of any one of a plurality of music pieces which correspond to one of the categories.

28. A machine-readable storage medium containing a group of instructions to cause said machine to implement a content creation method, said content creation method comprising:

a step of classifying a supplied text data set into any one of a plurality of categories in accordance with substance of the supplied text data set; and a step of selecting or generating a musical composition data set which corresponds to the category of the text data set classified by said step of classifying, wherein said step of classifying searches the supplied text data set for predetermined keywords pertaining to individual ones of the categories and identifies the category of the supplied text data set on the basis of frequencies of occurrence of the keywords searched for within the text data set.

29. A machine-readable storage medium containing a group of instructions to cause said machine to implement a content creation method, said content creation method comprising:

a step of classifying a supplied text data set into any one of a plurality of categories in accordance with substance of the supplied text data set; and a step of selecting or generating a musical composition data set which corresponds to the category of the text data set classified by said step of classifying, wherein the musical composition data set selected or generated by said step of selecting or generating is associated with the supplied text data set, to thereby generate content that contains information representative of the text data set and information representative of the musical composition data set, and wherein one set of the content contains information representative of a plurality of text data sets to be sequentially reproduced and information representative of a plurality of musical composition data sets corresponding to the plurality of text data sets.

30. A machine-readable storage medium containing a group of instructions to cause said machine to implement a content creation method, said content creation method comprising:

a step of classifying a supplied text data set into any one of a plurality of categories in accordance with substance of the supplied text data set; and a step of selecting or generating a musical composition data set which corresponds to the category of the text data set classified by said step of classifying, wherein the musical composition data set selected or generated by said step of selecting or generating is associated with the supplied text data set, to thereby generate content that contains information representative of the text data set and information representative of the musical composition data set, and wherein one set of the content contains a plurality of text data sets, a plurality of musical composition data sets, and table data descriptive of correspondency between the text data sets and the musical composition data sets and order of reproduction of the text data sets and the musical composition data sets.

31. A machine-readable storage medium containing a group of instructions to cause said machine to implement a content creation method, said content creation method comprising:

a step of classifying a supplied text data set into any one of a plurality of categories in accordance with substance of the supplied text data set;

a step of selecting or generating a musical composition data set which corresponds to the category of the text data set classified by said step of classifying; and a step of generating voice data corresponding to the supplied text data set.

32. A machine-readable storage medium containing a group of instructions to cause said machine to implement a content distribution method, said content distribution method comprising:

a step of distributing, via a communication network, content information that contains first position information indicative of a stored position of a text data set and second position information indicative of a stored position of a musical composition data set; and a step of receiving the content information distributed via said communication network;

a step of accessing, on the basis of said first position information contained in the content information received by said step of receiving, a first predetermined position, on said communication network, corresponding to said first position information, so as to receive the text data set distributed via said communication network, and a step of accessing, on the basis of said second position information contained in the received content information, a second predetermined position, on said communication network, corresponding to said second position information, so as to receive the musical composition data set distributed via said communication network.

33. A machine-readable storage medium containing a group of instructions to cause said machine to implement a method for receiving and using content information, said method comprising:

a step of receiving content information distributed via a communication network, the content information containing first position information indicative of a stored position of a text data set and second position information indicative of a stored position of a musical composition data set;

a step of, on the basis of said first position information contained in the content information received via said communication network, automatically connecting to a first predetermined position, on said communication network, corresponding to said first position information, so as to receive the text data set distributed via said communication network; and a step of, on the basis of said second position information contained in the received content information, automatically connecting to a second predetermined position, on said communication network, corresponding to said second position information, so as to receive the musical composition data set distributed via said communication network.

34. A signal for transfer over a communication network, said signal comprising:

first position information indicative of a stored position of a text data set;

second position information indicative of a stored position of digested text data representing an outline of the text data set; and third position information indicative of a stored position of a musical composition data set related to the text data set.

35. A signal for transfer over a communication network comprising a series of pieces of content information, each of said pieces of content information comprising:

first position information indicative of a stored position of a text data set; and second position information indicative of a stored position of a musical composition data set related to the text data set.

* * * * *